United States Patent [19]

Nickmeyer

[11] 4,287,502

[45] Sep. 1, 1981

[54] CARTRIDGE HEATER STRUCTURE

[75] Inventor: Walter V. Nickmeyer, Redlands, Calif.

[73] Assignee: Amark Industries, Inc., San Jacinto, Calif.

[21] Appl. No.: 49,877

[22] Filed: Jun. 19, 1979

[51] Int. Cl.[3] ..... H01C 1/02

[52] U.S. Cl. ..... 338/274; 219/342; 219/353; 219/541; 338/242; 338/243

[58] Field of Search ..... 338/274, 226, 233, 229, 338/237, 230, 269, 238, 275, 240, 242, 322, 243; 219/541, 544, 342, 318, 353, 335, 336, 523; 174/75 C, 78, 89; 29/610, 611

[56] References Cited

U.S. PATENT DOCUMENTS

| | | | |
|---|---|---|---|
| 1,698,289 | 1/1929 | Abbott | 338/274 X |
| 1,708,961 | 4/1929 | Abbott | 338/274 X |
| 3,156,491 | 11/1964 | Jackson et al. | 174/89 X |
| 3,374,307 | 3/1968 | Rauen et al. | 174/89 |
| 3,839,623 | 10/1974 | Portmann | 338/274 X |

FOREIGN PATENT DOCUMENTS

| | | | |
|---|---|---|---|
| 1064583 | 9/1959 | Fed. Rep. of Germany | 174/89 |
| 460156 | 1/1937 | United Kingdom | 174/75.2 |

*Primary Examiner*—C. L. Albritton

*Attorney, Agent, or Firm*—Georges A. Maxwell

[57] ABSTRACT

An elongate, electric resistance heater having a tubular case, a plug in and spaced from one end of the case and elongate, flexible jacketed power lines extending through the plug and axially outward from said end of the case, an elongate, tubular, flexible braided metal sheath about the lines and coupling means coupling said end of the case and the end portion of the sheath adjacent thereto, said coupling means including elongate concentric inner and outer tube parts arranged with said end portion of the sheath held tight therebetween, a radially outwardly projecting flange on one of said parts arranged within said end portion of the case adjacent said plugs and retaining means at said end of the case axially outward of the flange and holding the flange and its related parts and sheath against axial outward displacement in the case and relative to the lines.

16 Claims, 9 Drawing Figures

CARTRIDGE HEATER STRUCTURE

This invention has to do with a cartridge heater structure and is particularly concerned with a heater including novel conductor shielding means.

BACKGROUND OF THE INVENTION

The ordinary cartridge heater of the general class here concerned with comprises an elongate tubular metal case in which an elongate resistance wire is arranged. The resistance wire is supported in electric insulated relationship with the case by a compacted filler of granular dielectric material within the case and about the wire. The ends of the sheath are suitably plugged and sealed. The means plugging at least one end of the case is established of dielectric material through which one or a pair of elongate flexible jacketed power lines project. The inner ends of the power lines are electrically connected with related ends of the resistance wire. The outer ends of the power lines project freely from the plug or plugs and from their related ends of the case and extend to a suitable power supply.

Cartridge heaters of the general character here concerned with are used in a multitude of different environments. In many environments, it is necessary that the power lines be suitably shedded and protected. In such instances, it is common practice to engage or arrange the power lines for the heaters within elongate, flexible, tubular, braided metal sheaths, that is, within that form of flexible tubular sheathing which is braided of a multiplicity of fine, wire filaments. The most common braided sheathing is such that it can be extended or shortened longitudinally to a notable extent by the application of axially directed tensile and compressive forces and is such that its diametric extent is notably decreased or increased when it is extended or shortened longitudinally.

When the power lines of cartridge heaters are engaged within and protected by braided metal sheathing such as described above, it is common practice to simply slide and advance the sheaths longitudinally of the power lines so that the ends of the sheaths related to the heaters stop against and loosely engage the ends of the heaters. In such relationship of parts, the sheaths are subject to sliding longitudinally of the power lines and out of that position where they afford the protection sought to be afforded thereby. In order to prevent displacement of the sheaths, some of those working in the heater art have used various cements and the like to secure or fix the opposing ends of the heaters and the sheaths together. While such practices have met with varying degrees of success, use thereof has been avoided whenever possible since the time, labor and resulting costs in utilizing them is substantial and materially increases the costs of the resulting heater assemblies.

Still further, to the best of my knowledge and belief, those means which have been provided or utilized by the prior art to secure braided metal sheaths to or with related ends of cartridge heaters have afforded inadequate support for the end portions of the sheaths and their adjacent end portions of the power lines. The sheaths and power lines are subject to flexing excessively at their junctions with their related heaters with resulting premature hardening and breaking of the junctions.

OBJECTS AND FEATURES OF THE INVENTION

An object and feature of my invention is to provide novel mechanical coupling means coupling one end of an elongate cartridge heater case with an adjacent end of an elongate flexible braided metal sheath through which power lines for and connected with the heater freely extend.

Another object and feature of my invention is to provide a novel coupling structure comprising inner and outer tubular metal parts between which an end portion of the braided sheath is tightly engaged, through which the power lines freely extend and with which the heater case is fixedly engaged.

Yet another object and feature of my invention is to provide a novel coupling structure of the character referred to above wherein at least one of the tubular parts has a radially outwardly projecting flange arranged within its related end portion of the heater case, adjacent the plug therein and axially inward of a radially inwardly turned retaining lip formed on the end of the case.

Still another object and feature of my invention is to provide a combination sheath and coupling parts such as referred to above which can be easily and quickly assembled preparatory to relating the sheath and coupling parts with the power lines for and with the case of a related cartridge heater, whereby sub-assemblies of sheaths and coupling parts can be economically produced by unskilled labor and stored for subsequent assembly with power lines and subsequent assembly with heaters.

It is another object and feature of my invention to provide a coupling structure of the character referred to above wherein the tubular coupling parts are of substantial longitudinal extent to extend axially outward from their related end of the heater case, beyond the junction between the power lines and the plug in said end of the case whereby the portions of the power lines adjacent the plug are prevented from flexing excessively and work hardening.

Yet another object of my invention is to provide a structure of the character referred to above wherein the coupling parts are standard commercially available and inexpensive malleable metal eyelets.

It is still another object and feature of my invention to provide a coupling structure of the character referred to above wherein both tubular parts have radially outwardly projecting flanges and the sheath has an expanded radially outwardly flared end portion between and held in clamped engagement between the flanges.

It is yet another object and feature of my invention to provide a coupling structure of the character referred to wherein the radially extending longitudinally outwardly disposed flange within the end portion of the heater case is retained in the case by staking or forming portions of the case longitudinally outward of the flange radially inward; or by welding the flange to the case; or by fixing the flange within the case by solder; or by means of a resinous potting compound or cement.

The foregoing and other objects and features of my invention will be fully understood from the following detailed description of typical preferred forms and embodiments of the invention, throughout which description reference is made to the accompanying drawings.

DETAILED DESCRIPTION OF THE INVENTION

The structure of the present invention includes generally an elongate cartridge heater H with a pair of power lines L extending freely from one end thereof, an elongate, flexible braided metal sheath S engaged freely about and extending longitudinally of the lines L and a coupling structure C coupling the opposing adjacent ends of the heater and the sheath together.

The heater H includes an elongate cylindrical tubular metal case A with opposite front and rear ends 10 and 11; an elongate heating element E of suitably formed resistance wire arranged within and extending longitudinally of the case A, a filler F of compacted dielectric material within the case and about the element E to maintain the element in proper position within the case, a plug P of dielectric material in and closing the rear end 11 of the case, and means (not shown) plugging and/or sealing the other or front end of the case.

The power lines are elongate, flexible, jacketed electric conductors with front end portions extending through openings in the plug P and which are suitably connected with related ends of the element E and have elongate rear end portions projecting freely rearwardly from the plug P and from the rear end of the case.

The heater structure thus far described is typical of most standard or conventional cartridge heaters.

Figure 3:
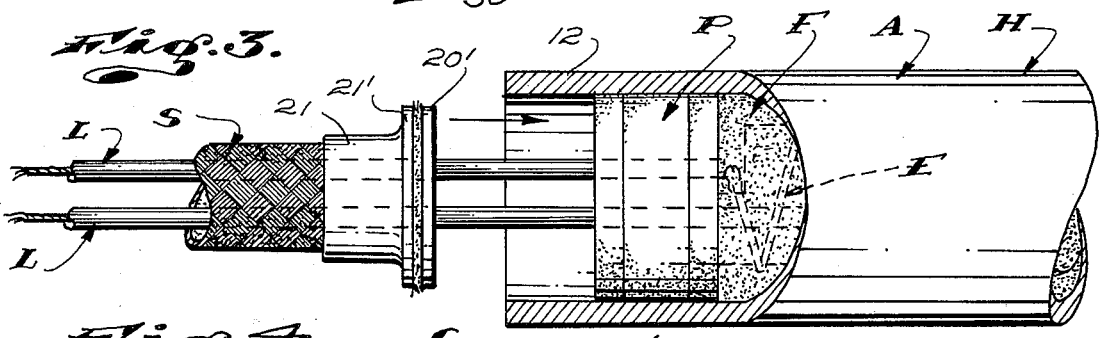
FIG. 3 is a view similar to FIG. 2 showing parts in another position.

In addition to the foregoing, the case A of the heater H that I provide is characterized by a longitudinally rearward projecting extension 12 at or defining the rear end of the case. The extension 12 projects a limited predetermined distance rearward from the plug P to occur in radial spaced relationship about the portions of the power lines L adjacent the plug, as clearly illustrated in FIG. 3 of the drawings.

Substantially any elongate metal jacketed or encased heater structure of the general character referred to above, which is such that an end of the jacket or case, at that end of the heater from which power lines L project, can be extended to occur about a portion of the lines and advantageously used in carrying out my invention.

The sheath S is commercially available braided wire, tubular, sheathing such as is commonly employed to protect and shield elongate electrical conductors against physical damage, shield high frequency inference and the like. Such tubular sheathing is most commonly woven or braided from fine strands of stainless steel wire and is available in different lengths, weights and diameters.

One notable characteristic of such braided tubular sheathing is: its diametric extent can be enlarged or expanded by the application of axially disposed compressive forces and can be reduced or constricted by oppositely disposed tensile forces. Expansion of the diametric extent of braided tubular sheathing greatly facilitates engaging or arranging such sheathing about lines and other parts. Thereafter, such sheathing can be drawn and constricted into close tolerances with parts engaged therein.

The above characteristic of braided tubular sheathing also allows for easy and extensive radial outward flaring of the ends of the sheathing without adverse effects. The sheath S is freely engaged about and extends longitudinally of the rear portions of the pair of lines L, with the rear ends of the lines L extending from the rear ends of the sheath for convenient access.

The coupling structure C that I provide includes a pair of elongate, concentric, inner and outer tube parts 20 and 21. The inner tube part 20 is engaged freely about the lines L and within the forward end portion of the sheath S. The outer tube part is engaged about the exterior of that portion of the sheath which occurs about the inner tube part 20. The inner tube part is of a selected size having an inside diameter which is sufficient to freely accommodate the lines L. The outer tube part is of a selected size having an inside diameter which is such that the end portion of the sheath S between the tube parts is tightly engaged between and held by the tube parts.

The tube parts extending longitudinally of the portions of the sheath and lines with which they are related have front and rear ends. The front end of at least one of the tube parts has a flat radially outwardly projecting annular flange formed thereon. The outside diameter of the flange is sufficiently less than the inside diameter of the rear end portion 12 of the case A to be freely accommodated by the case and is positioned within the case.

The flange establishes a flat axially forwardly disposed end face which opposes and stops against the rear end surface of the plug P, which surface of the plug is preferably formed to be substantially flat.

Figure 1:
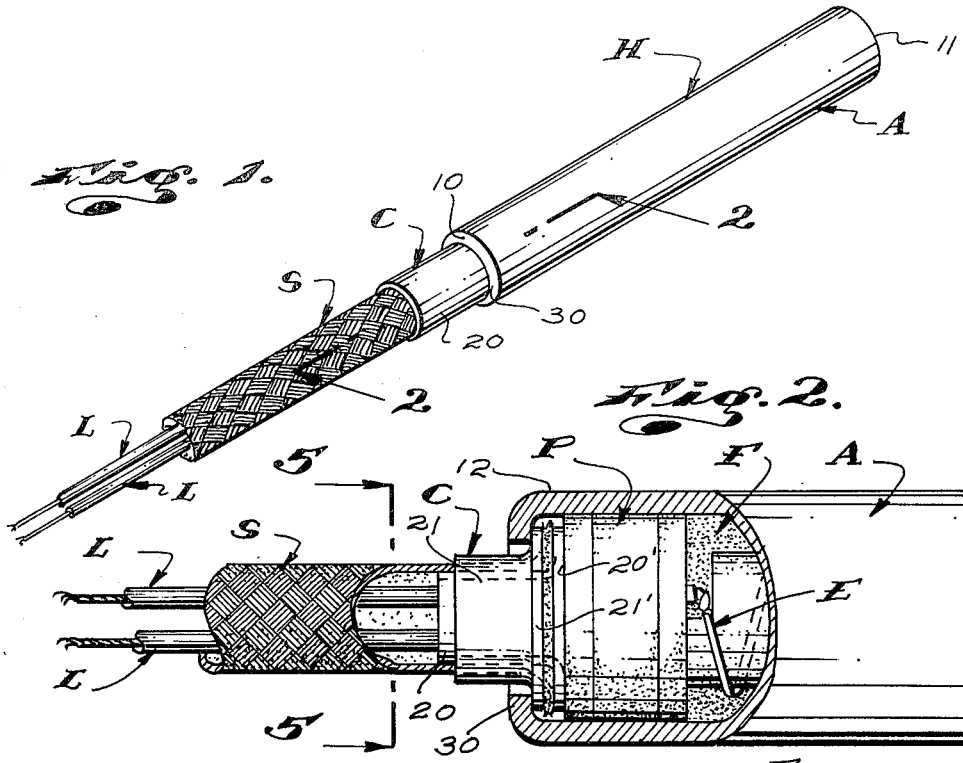
FIG. 1 is an isometric view of the heater structure embodying my invention.
Figure 2:
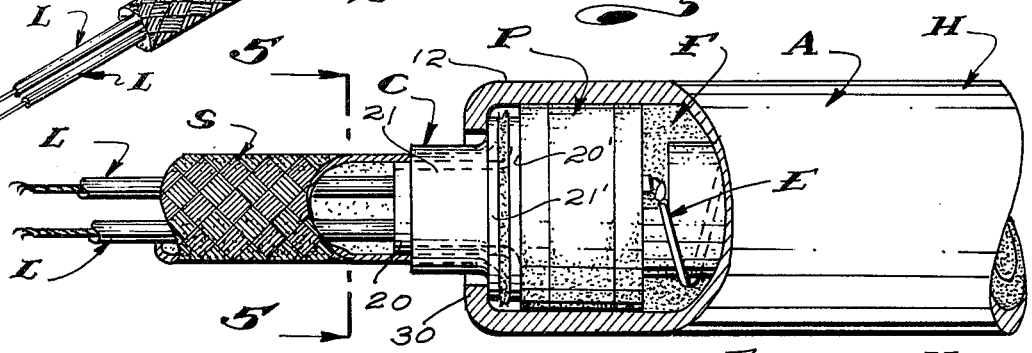
FIG. 2 is an enlarged detailed sectional view taken substantially as indicated by line 2—2 on FIG. 1.

The rear end portion 12 of the heater case is rolled or formed radially inwardly to establish a retaining lip 30, which overlies and engages the axially rearwardly disposed surface of the flange, about the outer peripheral portion thereof, as clearly shown in FIG. 2 of the drawings, thereby holding the flanged tube part (with the sheath secured thereto) in assembled relationship with the heater H.

In practice, the retaining flange of the coupling structure can be on the inner or outer tube part.

In the preferred carrying out of my invention, and as illustrated in FIGS. 2 through 5 of the drawings, both tube parts 20 and 21 have flanges 20' and 21' at their forward ends. The flange 20' on the inner part occurs axially forward of the flange 21' on the outer tube part. The forward portion of the sheath S is flared to extend radially outward between the pair of flanges 20' and 21', as illustrated.

When this preferred form of coupling means is used, and the rear end portion 12 of the heater case A is formed radially inwardly to define the retaining lip 30 which engages the rear surface of the flange 21', the forward flange 20' is urged into stopped engagement with the plug P of the heater H and the flared portion of the sheath S is clamped securely between the flanges 20' and 21'.

It will be apparent that with the structure set forth above, when the sheath S is flared out between the flanges 20' and 21' on the tube parts 20 and 21, and the tube parts are held tightly together, axially of the construction, the sheath is securely held between and with the tube parts by moderate or even light forces between the parts. Accordingly, upon assembly of the coupling means, the sheath need not be subjected to excessive forces which might tend to damage or otherwise adversely affect the structural integrity of the sheath.

In practice, the sheath S and the tube parts 20 and 21 are assembled prior to their being related with the heater H and can be assembled with the lines L before or after the tube parts and sheath are interengaged, as desired or as circumstances require.

Figure 4:
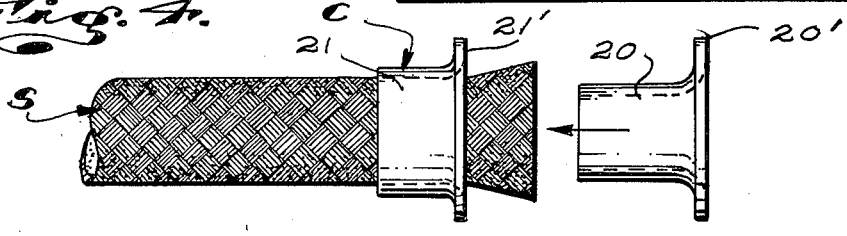
FIG. 4 is a view of parts in another position.
Figure 5:
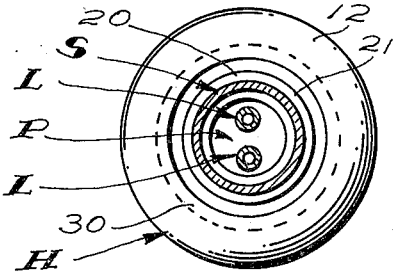
FIG. 5 is a sectional view taken as indicated by line 5—5 on FIG. 1.

In practice, and as illustrated in FIG. 4 of the drawings, the forward end of the sheath is first engaged through the outer tube part 21 and its forward terminal end is flared to receive the inner tube part 20. Thereafter, the inner and outer tube parts are urged axially toward each other into the circumferential confines of the outer tube part, with the sheath tight therebetween. As the tube parts are urged into interengagement with each other and with the sheath in the manner set forth above, the flared stock or portion of the sheath forward of the flange 21' and rearward of the flange 20' is flared further and is formed to extend radially outwardly between and in snug or tight engagement between the flanges.

In practice, the flared stock or portion of the sheath need not extend radially outward to the other periphery of the flanges. Should it extend outward and beyond the flanges, it can be cut or trimmed off, if excess sheath stock is present.

In practice, it has been found that it is often desirable to have some excess sheath stock extending radially outward from the flanges, as such stock serves as a packing which takes up tolerances between the coupling parts and the heater case and facilitates assembly of the construction.

Figure 6:
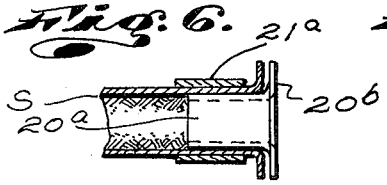
FIG. 6 is a view of a sub-assembly embodying another form of my invention.
Figure 7:
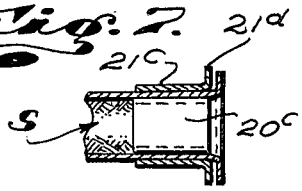
FIG. 7 is a view of a sub-assembly embodying yet another form of my invention.

As noted above, both tube parts 20 and 21 need not be flanged. As shown in FIG. 6 of the drawings, the outer tube part $21^a$ has no flange and the inner tube part $20^a$ is flanged as at $20^b$. As shown in FIG. 7 of the drawings, the inner tube part $20^c$ is not flanged and the outer tube part $21^c$ is flanged as at $20^d$. In both of these modified forms of the invention, the forward end portion of the sheath is flared radially outward in such a manner that it is subject to being held captive between its related flange and the retaining lip 30 of the case or the plug P of its related heater structure.

Figure 8:
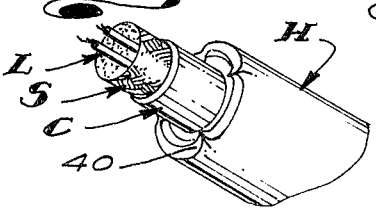
FIG. 8 is an isometric view showing another means for retaining parts together.
Figure 9:
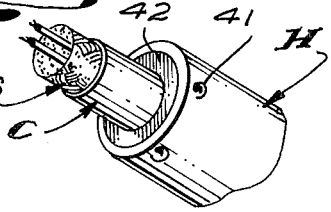
FIG. 9 is a view similar to FIG. 8 showing another means for securing parts together.

In practice, and as shown in FIGS. 8 and 9 of the drawings, the coupling means C can be fixedly engaged within the rear portion of the heater case A by staking the rear end portion of the case radially inwardly as indicated at 40 in FIG. 8 of the drawings; or by spot or induction welding the case to the outer perimeters of the flanges 20' and 21' and/or to the sheath stock occurring about the flanges as indicated at 41 in FIG. 9 of the drawings. Further, as is shown in FIG. 9 of the drawings, the coupling means can be set and fixed in the rear end portion of the heater case A by a deposit or epoxy cement 42 or other suitable cement and/or potting material, within the case, axially rearward of the flanged portion of the coupling means.

The tube parts 20 and 21 in the preferred form of my invention and the flanged tube parts $20^a$ and $21c$ in the forms of my invention shown in FIGS. 6 and 7 of the drawings can be and are preferably standard commercially available eyelets of desired selected size. Such eyelets are commonly used throughout the electrical arts to reinforce apertures through panel structures, fasten parts together and the like. The eyelets employed in carrying out this invention are preferably established of brass or aluminum but can be made of any other suitable material, including certain resinous plastics.

With the coupling means C provided, it will be apparent that the sheath S is securely coupled with the rear end of the cartridge heater in a neat and attractive manner. Further, the sheath and cartridge heater are secured in such a manner that the sheath is directed rearwardly from the heater and is supported so that it is not subject to being crimped or otherwise worked and bent in a manner that is likely to result in separation or breaking of the junction between the heater and the sheath.

The inner tube part, occurring in spaced relationship about the portions of the lines L related to the coupling means serve to prevent bending and working of those portions of the lines in a manner likely to work harden and cause breaking and separation of the lines where they enter the plug P.

The invention here provided has been reduced to practice and subjected to extensive laboratory and field testing. It has been determined that the coupling structure C provided is less time-consuming to put into practice and is less costly to use than are most means employed by the prior art to secure braided sheathing to cartridge heater cases. Further, the resulting junction between the sheath and heater is as secure, is more dependable and is more durable than are most junction structures between sheaths and heaters commonly provided by the prior art.

Having described only typical preferred forms and applications of my invention, I do not wish to be limited to the specific details herein set forth, but wish to reserve to myself my variations and/or modifications that may appear to those skilled in the art and which fall within the scope of the following claims.

Having described my invention, I claim:

1. A cartridge heater structure comprising an elongate cylindrical metal case with front and rear ends, an elongate heater element supported within the case, a plug of dielectric material within at least the rear portion of the case axially forward of the rear end of the case, elongate flexible jacketed power lines with front end portions extending through the plug and electrically connected with said element and rear end portions extending rearwardly from the case, an elongate tubular flexible braided metal sheath with front and rear ends engaged about and extending longitudinally of the lines and a coupling structure coupling the front end of the sheath with the rear end of the case, said coupling structure including an elongate axially extending inner tube part freely engaged about the lines and within the front portion of the sheath, an elongate axially extending outer tube part engaged about the inner tube part with a forward portion of the sheath held securely therebetween, one tube part has a radially outwardly projecting flange arranged within the rear portion of the case between the rear end of the case and the plug and retaining means between the rear end portion of the case and said flange retaining the flange in the case and against axial rearward displacement therefrom.

2. The cartridge heater structure set forth in claim 1 wherein said retaining means includes a radially inwardly turned annular lip formed on the rear end of the case rearward of and engaging said flange.

3. The cartridge heater structure set forth in claim 1 wherein said retaining means includes circumferentially spaced radially inwardly formed portions of the rear end portion of the case rearward of an engaging said flange.

4. The cartridge heater structure set forth in claim 1 wherein said retaining means includes welds about and between the case and adjacent portions of said flange.

5. The cartridge heater structure set forth in claim 1 wherein said retaining means includes a deposit of cement within the rear end portions of the case about said outside tube part and at the rear of said flange.

6. The cartridge heater structure set forth in claim 1 wherein the flange is on said inner tube part.

7. The cartridge heater structure set forth in claim 6 wherein said retaining means includes a radially inwardly turned annular lip formed on the rear end of the case rearward of and engaging said flange.

8. The cartridge heater structure set forth in claim 6 wherein said retaining means includes circumferentially spaced radially inwardly formed portions of the rear end portion of the case rearward of and engaging said flange.

9. The cartridge heater structure set forth in claim 6 wherein said retaining means includes welds about and between the case and adjacent portions of said flange.

10. The cartridge heater structure set forth in claim 6 wherein said retaining means includes a deposit of cement within the rear end portions of the case about said outside tube part and at the rear of said flange.

11. The cartridge heater structure set forth in claim 1 wherein the flange is on said outer tube part.

12. The cartridge heater structure set forth in claim 11 wherein said retaining means includes a radially inwardly turned annular lip formed on the rear end of the case rearward of and engaging said flange.

13. The cartridge heater structure set forth in claim 11 wherein said retaining means includes circumferentially spaced radially inwardly formed portions of the rear end portion of the case rearward of and engaging said flange.

14. The cartridge heater structure set forth in claim 11 wherein said retaining means includes welds about and between the case and adjacent portions of said flange.

15. The cartridge heater structure set forth in claim 11 wherein said retaining means includes a deposit of cement within the rear end portions of the case about said outside tube part and at the rear of said flange.

16. The cartridge heater structure set forth in claim 1 wherein said flange is on said outer tube part, said inner tube part has a like flange and said sheath has a portion flared radially outwardly and in clamped engagement between said flange on the outer part and said like flange on said inner part.

* * * * *